United States Patent [19]

Donovan

[11] Patent Number: 4,634,149

[45] Date of Patent: Jan. 6, 1987

[54] LABEL

[75] Inventor: John A. Donovan, Hatfield Peverel, England

[73] Assignee: Don Marketing Management Limited, United Kingdom

[21] Appl. No.: 713,909

[22] PCT Filed: Jul. 19, 1984

[86] PCT No.: PCT/GB84/00256

§ 371 Date: Mar. 18, 1985

§ 102(e) Date: Mar. 18, 1985

[87] PCT Pub. No.: WO85/00685

PCT Pub. Date: Feb. 14, 1985

[30] Foreign Application Priority Data

Jul. 20, 1983 [GB] United Kingdom ..... 8319632
Aug. 18, 1983 [GB] United Kingdom ..... 8321912

[51] Int. Cl.[4] ..... B42D 15/00

[52] U.S. Cl. ..... 283/102; 283/81; 283/903

[58] Field of Search ..... 283/81, 100, 101, 102, 283/103, 104, 105, 903

[56] References Cited

U.S. PATENT DOCUMENTS 2,091,346 4/1937 Wright ..... 40/4
2,096,960 10/1937 Colby ..... 283/105
2,321,184 6/1943 Butterworth ..... 283/101
3,524,782 8/1970 Buske ..... 283/81

FOREIGN PATENT DOCUMENTS 2112797 5/1972 France .
598964 11/1977 Switzerland .
2075918A 11/1981 United Kingdom ..... 283/102

OTHER PUBLICATIONS

Magnavox, "Touch-Tune to Touchdown Sweepstakes", placed into U.S. PTO Shoe on Jul. 12, 1977.

*Primary Examiner*—Paul A. Bell
*Attorney, Agent, or Firm*—Lowe Price LeBlanc Becker & Shur

[57] ABSTRACT

A label comprises a plurality of separate first indicia printed on one side thereof with each camouflaged by an opaque layer. The indicia representing numbers are segregated in a grid pattern. The first indicia represent possible chip positions when betting on a game of roulette. The label also has second indicia comprising a perspective view of a roulette wheel and a predetermined number of first indicia representing the equivalent or bets. To play, the label is cut or torn for removal from the exterior of a container to expose the first and second indicia, enabling a player to remove desired portions of the camouflaged layer to reveal first indicia numbers corresponding to the second indicia numbers.

5 Claims, 1 Drawing Figure

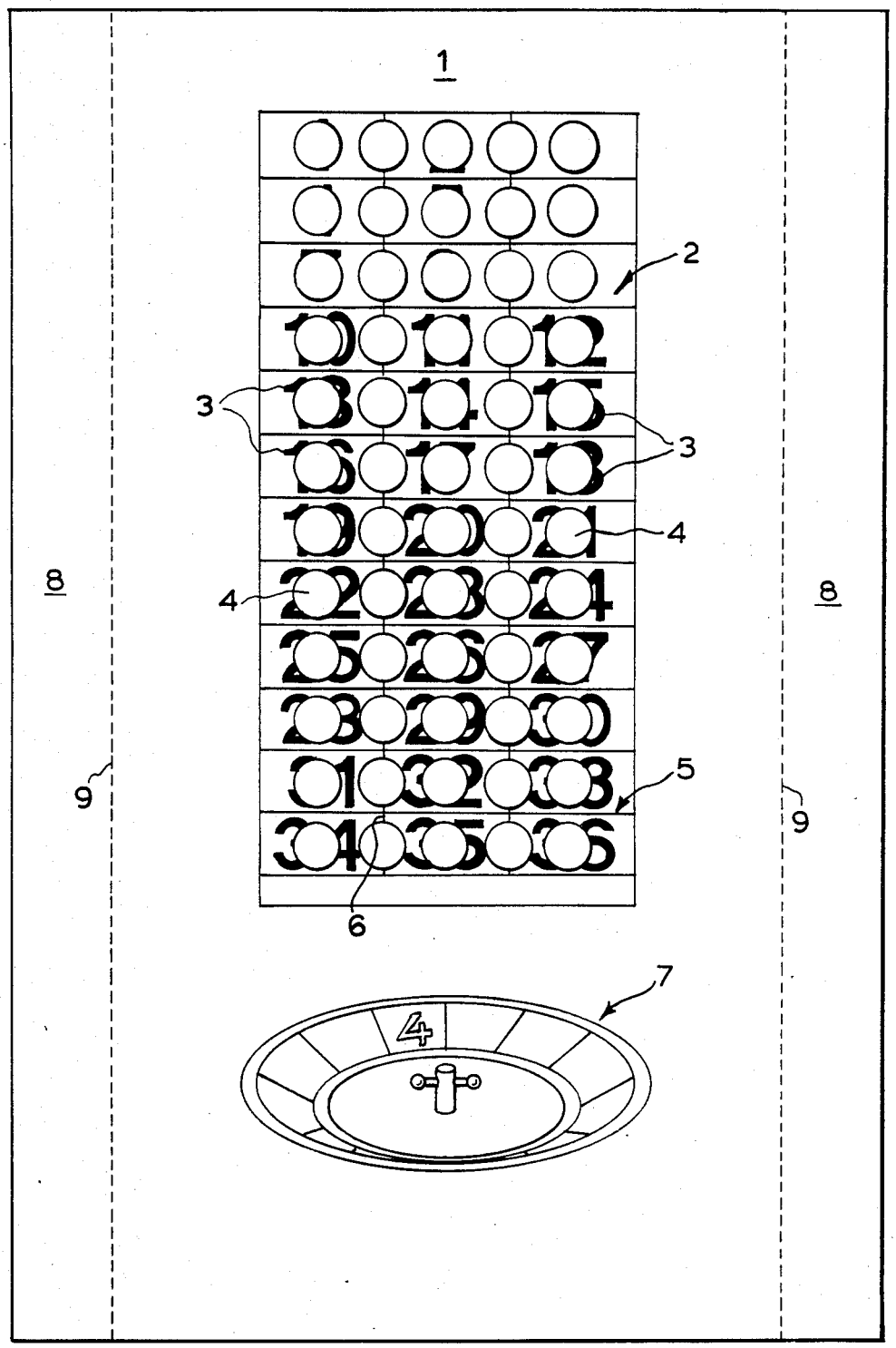
1
2
3
3
4
4
5
6
7
8
8
9
9

LABEL

The invention relates to a label.

According to the invention there is provided a label for a container, comprising means releasably to secure the label to the container and bearing on one side, a plurality of separate first indicia each of which is normally camouflaged by a removable material which can be removed selectively in order to expose the indicia in a desired or preferred sequence.

There may be included on the one side a second indicia which is a different view of the first indicia and without the camouflaging material. When the second indicia is viewed, the first indicia can be removed in the desired or preferred sequence.

The first and second indicia may be on a side of the label facing the container and hidden from view before release therefrom.

The removable material may be an opaque layer on each indicia. The means to releasably secure the label may be adhesive edge strips which may be connected with the remainder of the label by perforations, whereby the remainder of the body of the label can be removed from the container by tearing the perforations.

The means releasably to secure the label may comprise substantially parallel tear lines spaced apart over the label and by which the part of the label bearing the first and second indicia therebetween may be removed when the label is cut or torn along the tear lines.

The tear lines may be perforated or merely printed or otherwise applied to the label.

A label embodying the invention is hereinafter described, by way of example, with reference to the accompanying drawing, which shows to an enlarged scale a part of the label according to the invention.

Referring to the drawing, the label 1 comprises a plurality of separate first indicia 2 comprising a plan view of a plurality of indicia in the form of numbers, in this case thirty numbers each of which is camouflaged by an opaque layer in the form of a disc 4. The numbers 3 are segregated in a grid pattern 5 of which some of the lines 6 themselves are also camouflaged by a disc shaped removable layer 4. All the discs 4 comprise a layer of a mixture of a rubber and graphite which is relatively readily removed by a thumb or finger nail, or edge of a coin. Some of the numbers, in this case 12, have a coloured disc or dot (not shown) say a tinted or pastel coloured disc, under the particular camouflage layer disc 4. For example if the disc 4 over number "10" is removed, there is revealed a disc or dot.

The plurality of indicia 2 represent in the embodiment possible chip positions when betting on a game of roulette. The label 1 also has a second indicia comprising a perspective view of a roulette wheel 7 and table (not shown), without the grid markings being shown, and there are on the table twelve chips shown as being placed, in other words they comprise, the equivalent of bets. The second indicia 7 thus shows a different view of the first indicia 2.

The label 1 thus comprises a game device which is a game of skill.

In use, the label 1 is affixed to the exterior surface of a container by adhesive edge strips 8. The container may be a bottle containing an alcoholic beverage. The outside of the label 1, the one immediately visible, advises the purchaser of the game on the reverse side of the label, and invites him or her to remove the label. There may be a collar (not shown) round the neck of the bottle bearing instructions.

The player if he wants to partake in the game removes the label 1 by tearing off or slitting down perforations or tear lines 9 on the opposite side to the first and second indicia and reverses the part removed in order to study the perspective view, the second indicia, to try to decide where the 12 chips are placed. He or she then removes the opaque layer 4 from twelve numbers 3 of the overhead or plan view 2 (the first indicia) to see whether a disc or dot is revealed, so showing whether a correct selection has been made. The disc or dot represents a bet.

The opaque layer may comprise a mixture of rubber and graphite secured to the reverse side temporarily to conceal the indicia until removed therefrom as by scratching or rubbing. There may be one layer camouflaging all the indicia or each indicia may be camouflaged by its own individual layer.

The one side of the label may be the reverse side when the label is in position on the container.

The container may be a bottle, carbon, tin, can, or the like particularly of the kind in which food or drink is normally put up for sale.

It will be understood that the invention extends to a container including a label as hereinbefore defined.

I claim:

1. In a label for a container, the improvement comprising means for releasably securing the label to the container, said label bearing on one side thereof a plurality of printed separate first game indicia each normally camouflaged by a removable material which can be removed selectively in order to expose the indicia in a desired sequence, said releasable securing means being arranged with respect to said one side such that when the label is releasably secured to said container said one side and first indicia thereon face the container and are thereby hidden from view prior to separation of said label from the container further including on said one side at least one printed second indicia which is a different view of at least one of the first indicia, whereby a player of said game may selectively remove the camouflaging material to match the first indicia with the second indicia.

2. A label according to claim 1, wherein the removable camouflaging material is an opaque layer on each first indicia.

3. A label according to claim 1, wherein the releasable securing means includes adhesive edge strips connected with the remainder of the label by perforations.

4. A label according to claim 1, wherein the releasable securing means comprises substantially parallel tear lines spaced apart over the label and by which the part of the label bearing the first and second indicia therebetween is removed when the label is cut or torn along the tear lines.

5. A label according to claim 4, said tear lines being printed on the label.

* * * * *